US006499682B1

(12) United States Patent
Virving

(10) Patent No.: US 6,499,682 B1
(45) Date of Patent: Dec. 31, 2002

(54) REFINING ELEMENTS

(75) Inventor: Nils Virving, Hässelby (SE)

(73) Assignee: Valmet Fibertech AB (SE)

( * ) Notice: Subject to any disclaimer, the term of this patent is extended or adjusted under 35 U.S.C. 154(b) by 0 days.

(21) Appl. No.: 09/555,159

(22) PCT Filed: Nov. 23, 1998

(86) PCT No.: PCT/SE98/02124

§ 371 (c)(1),
(2), (4) Date: May 24, 2000

(87) PCT Pub. No.: WO99/26725

PCT Pub. Date: Jun. 3, 1999

(30) Foreign Application Priority Data

Nov. 25, 1997 (SE) ..... 9704350

(51) Int. Cl.[7] ..... B02C 7/12
(52) U.S. Cl. ..... 241/261.2
(58) Field of Search ..... 241/261, 261.2, 241/261.3

(56) References Cited

U.S. PATENT DOCUMENTS

| | | | | |
|---|---|---|---|---|
| 3,040,997 A | * | 6/1962 | Borden | 241/261.3 |
| 3,620,463 A | * | 11/1971 | Feder | 241/261 |
| 4,269,362 A | * | 5/1981 | Berggren | 241/261.2 |
| 5,042,726 A | | 8/1991 | Reinhall | 241/28 |

* cited by examiner

*Primary Examiner*—Lowell A. Larson
(74) *Attorney, Agent, or Firm*—Lerner, David, Littenberg, Krumholz & Mentlik, LLP

(57) ABSTRACT

Apparatus is disclosed for refining lignocellulosic material including a pair of refining elements facing each other for relative rotation to refine the lignocellulosic material passing through the refining gap between the refining elements. The refining elements include rows of projecting working pins with substantially circular cross-sections and strips projecting above the refining element surface and extending substantially circumferentially along the refining surfaces. The rows of projecting working pins are disposed at selected radial positions on the two refining surfaces so that they avoid contact with each other during relative rotation of the two refining surfaces.

8 Claims, 1 Drawing Sheet

REFINING ELEMENTS

FIELD OF THE INVENTION

The present invention relates to refining elements for use in disk-type refiners for working, i.e. for defibering, refining or dispersing lignocellulosic fiber material in the form of chips or pulp. The working of the lignocellulosic material can have the purpose to manufacture, for example, recycled fiber pulp or mechanical pulp, such as thermomechanical pulp (TMP) and chemi-thermomechanical pulp (CTMP). More particularly, the present invention relates to a pair of cooperating refining elements, which are intended to be positioned directly in front of each other on opposed refining disks in a refiner of this kind.

BACKGROUND OF THE INVENTION

The working of fibrous material takes place in the refining gap formed between the refining elements on two opposed refining disks rotating relative to each other. The fibrous material is thereby subjected to mechanical action by working means on the refining elements, while it simultaneously moves by the effects of centrifugal force. The working means can be formed as continuous or discontinuous bars, teeth or in some other manner.

During the defibering of fibrous material in the form of chips, it is desired for the chips to be disintegrated to individual fibers with a minimum of fiber shortening. Experiments have proved that the configuration of the refining elements in the inner portion of the refining gap is of great importance for the feed of the material through the refining gap as well as for the defibering process. During the dispersion of recycled fiber pulp, working is desired which does not cause any fiber shortening or reduction in the freeness value (CSF) of the pulp.

Working, which causes fibrillation and fiber shortening, occurs most often when the refining means are formed with bars, by the effect of the edges of the bars. Conventional refining elements with working means in the form of bars with intermediate grooves can also result in a non-uniform flow of the material through the refining gap. This results in the load on the motor or motors driving one or both of the refining disks being uneven.

As a result thereof, the process will be difficult to control, and the energy consumption increases. It can also effect the quality of the worked pulp.

SUMMARY OF THE INVENTION

These and other difficulties in the prior art have now been alleviated by the invention of apparatus for refining lignocellulosic material comprising a first refining element including a first refining surface, and a second refining element including a second refining surface facing the first refining surface thereby providing a refining gap therebetween, the first and second refining surfaces being relatively rotatable with respect to each other whereby the lignocellulosic material can be refined while passing through the refining gap, the first refining surface including a first plurality of rows of projecting working pins having a substantially circular cross-section and at least one first strip projecting above and extending substantially circumferentially along the first refining surface, and the second refining surface including a second plurality of rows of projecting working pins having a substantially circular cross-section and at least one second strip projecting above and extending substantially circumferentially along the second refining surface, the first and second pluralities of rows of projecting working pins disposed at selected radial positions on the first and second refining surfaces whereby the first and second pluralities of rows of projecting working pins avoid contact with each other upon the relative rotation of the first and second refining surfaces. In a preferred embodiment, the first and second pluralities of rows of projecting working pins are disposed at alternating radial positions with respect to each other.

In accordance with one embodiment of the apparatus of the present invention, the at least one first strip comprises a plurality of first strips and the at least one second strip comprises a plurality of second strips.

In accordance with another embodiment of the apparatus of the present invention, the first and second pluralities of rows of projecting working pins are substantially cylindrical, and include a rounded upper surface distal from the first and second refining surfaces.

In accordance with another embodiment of the apparatus of the present invention, the at least one first and second strips are disposed along an arc. Preferably, the at least one first and second strips are disposed adjacent to the first and second pluralities of rows of projecting working pins on the first and second refining surfaces.

In accordance with another embodiment of the apparatus of the present invention, the at least one first and second strips extend continuously across the entire first and second refining surfaces.

In accordance with another embodiment of the apparatus of the present invention, the at least one first and second strips extend discontinuously across the first and second refining surfaces.

In accordance with another embodiment of the apparatus of the present invention, the first and second refining surfaces each includes an inner radial portion and an outer radial portion, the first and second plurality of rows of projecting working pins on the at least one first and second strips being disposed on the inner radial portions of the first and second refining surfaces. Preferably, the apparatus includes working means for the lignocellulosic material disposed on the outer radial portions of the first and second refining surfaces. In a preferred embodiment, the working means comprises a plurality of radially projecting bars.

The present invention offers a solution to the above problems. Opposed cooperating refining elements are provided with projecting working means in the form of pins with a circular cross-section. The pins on one of the refining elements are arranged to extend into the interspace between the pins on the opposed cooperating refining element. The refining elements are also provided with flow restrictions in the form of strips extending substantially in the circumferential direction.

BRIEF DESCRIPTION OF THE DRAWINGS

The present invention is described in greater detail in the following detailed description, which, in turn, refers to the accompanying Figures illustrating an embodiment of refining elements according to the present invention, in which.

DETAILED DESCRIPTION

Figure 1:
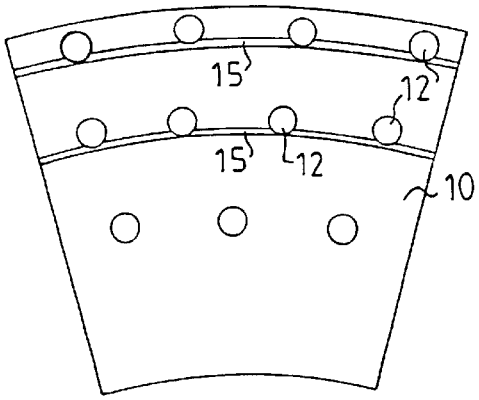
FIG. 1 is a top, elevational view of one of the cooperating refining elements in accordance with the present invention.
Figure 2:
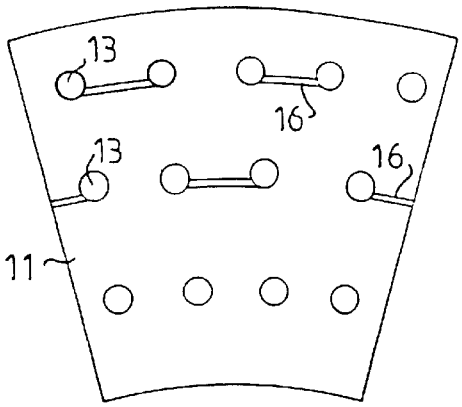
FIG. 2 is a top, elevational view of a second cooperating refining element in accordance with the present invention.
Figure 3:
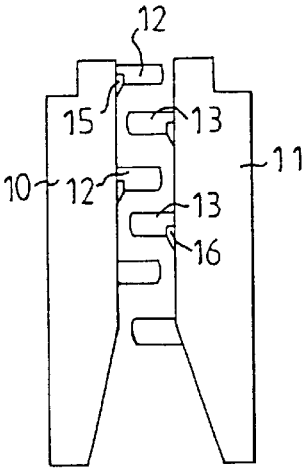
FIG. 3 is a side, elevational view of a pair of refining elements cooperating in accordance with the present invention.
Figure 4:
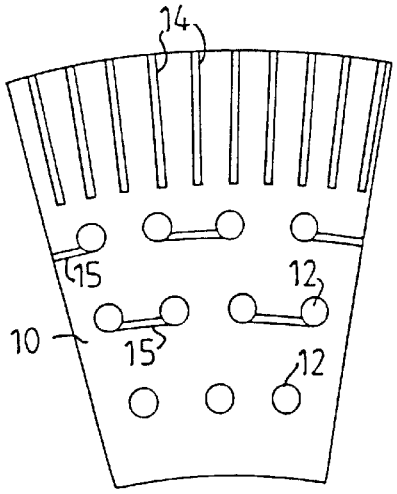
FIG. 4 is top, elevational view of an alternative configuration of one refining element in accordance with the present invention.

Referring to the Figures, in which like reference numerals refer to like elements thereof, FIGS. 1 and 2 show cooperating refining elements, 10 and 11, which are intended to be positioned on each of two opposed refining disks in a refiner where the refining disks are rotary relative to each other. The refining elements shown are provided with projecting working means in the form of pins, 12 and 13, with substantially circular cross-section, which are arranged in several rows in the circumferential direction. The rows of pins are located radially spaced from each other across the entire surface of the refining elements. These pins, 12 and 13, can alternatively be arranged only in an inner zone on the refining elements, 10 and 11. An outside located zone can then be provided with conventional working means, for example bars 14.

The pins, 12 and 13, are arranged in at least two radially spaced rows and be cylindrical with a diameter of from about 10 to 30 mm, preferably from about 15 to 25 mm, with rounded tops. Their length is from about 10 to 30 mm, preferably from about 15 to 25 mm. Alternatively, conical pins can be used. In working position the pins extend transversely across the refining gap essentially all the way to the surface of the opposed refining element.

The refining elements, 10 and 11, are also provided with flow restrictions in the form of strips, 15 and 16, which substantially extend in the circumferential direction. Compared with the pins, the strips are quite low, suitably from about 4 to 12 mm, preferably from about 6 to 10 mm. The strips can be placed relative to the pins along arcs. Alternatively, they can be given a direction slightly deviating from an arc, i.e. in which the radius increases or decreases along a strip. The strips can be continuous or discontinuous. Discontinuous strips can extend between two pins, for example.

During the working of the material during its passage outward through the refining gap between the co-operating refining elements, 10 and 11, the material will be acted upon by the pins, 12 and 13, and strips, 15 and 16, in a manner which yields a very uniform feed. At the same time, an effective but mild start of the defibration and, respectively, dispersion is obtained. The strips, 15 and 16, have an object of effecting the residence time of the material in the refining gap. For this purpose, the height and direction of the strips are of decisive importance. This favorable effect on the material implies that even a non-uniform supply of material is balanced in the refining gap, which has a stabilizing effect on the entire working process.

By positioning the refining elements according to the present invention on the inner portion of the refining disks, conventional refining elements can be arranged on the outer portion of the refining disks and thereby improve the stability of the material flow and motor load. This applies also when the refining elements according to the present invention have an inner zone with pins, 12 and 13, and an outer zone with conventional working means, for example in the form of bars 14.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for refining lignocellulosic material comprising a first refining element including a first refining surface, and a second refining element including a second refining surface facing said first refining surface thereby providing a refining gap therebetween, said first and second refining surfaces being substantially planar and relatively rotatable with respect to each other whereby said lignocellulosic material can be refined while passing through said refining gap, said first refining surface including a first plurality of rows of projecting working pins being substantially cylindrical, having a substantially circular cross-section, having a diameter of from 20 to 30 mm and including a rounded upper surface, and at least one first strip projecting above and extending substantially circumferentially along said first refining surface, and said second refining surface including a second plurality of rows of projecting working pins having a substantially circular cross-section and at least one second strip projecting above and extending substantially circumferentially along said second refining surface, said first and second pluralities of rows of projecting working pins disposed at selected radial positions on said first and second refining surfaces and said at least one first and second strips extending discontinuously across said first and second refining surfaces whereby said first and second pluralities of rows of projecting working pins avoid contact with each other upon said relative rotation of said first and second refining surfaces.

2. The apparatus of claim 1 wherein said first and second pluralities of rows of projecting working pins are disposed at alternating radial positions with respect to each other.

3. The apparatus of claim 1 wherein said at least one first strip comprises a plurality of first strips and said at least one second strip comprises a plurality of second strips.

4. The apparatus of claim 1 wherein said at least one first and second strips are disposed along an arc.

5. The apparatus of claim 4 wherein said at least one first and second strips are disposed adjacent to said first and second pluralities of rows of projecting working pins on said first and second refining surfaces.

6. The apparatus of claim 1 wherein said first and second refining surfaces each includes an inner radial portion and an outer radial portion, said first and second plurality of rows of projecting working pins and said at least one first and second strips being disposed on said inner radial portions of said first and second refining surfaces.

7. The apparatus of claim 6 including working means for said lignocellulosic material disposed on said outer radial portions of said first and second refining surfaces.

8. The apparatus of claim 7 wherein said working means comprises a plurality of radially projecting bars.

* * * * *